US011227487B2

(12) United States Patent
Suzuki

(10) Patent No.: US 11,227,487 B2
(45) Date of Patent: Jan. 18, 2022

(54) SERVER DEVICE AND CONGESTION IDENTIFICATION METHOD

(71) Applicant: TOYOTA JIDOSHA KABUSHIKI KAISHA, Toyota (JP)

(72) Inventor: Keiko Suzuki, Tokyo (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 203 days.

(21) Appl. No.: 16/201,146

(22) Filed: Nov. 27, 2018

(65) Prior Publication Data

US 2019/0189004 A1 Jun. 20, 2019

(30) Foreign Application Priority Data

Dec. 18, 2017 (JP) ..... JP2017-242125

(51) Int. Cl.
*G08G 1/01* (2006.01)
*G08G 1/052* (2006.01)

(52) U.S. Cl.
CPC ..... *G08G 1/0133* (2013.01); *G08G 1/0112* (2013.01); *G08G 1/0141* (2013.01); *G08G 1/052* (2013.01)

(58) Field of Classification Search
CPC .. G08G 1/0133; G08G 1/0112; G08G 1/0141; G08G 1/052; G08G 1/012
See application file for complete search history.

(56) References Cited

U.S. PATENT DOCUMENTS

2006/0161334 A1* 7/2006 Teramae ..... G08G 1/096866 701/117
2015/0302718 A1* 10/2015 Konigsberg ..... A61B 5/18 340/575
2015/0379359 A1 12/2015 Han et al.
2016/0300150 A1* 10/2016 Watts-Fitzgerald ..... G08G 1/0129
2017/0004707 A1* 1/2017 Fowe ..... G08G 1/0129
2017/0076598 A1* 3/2017 Scofield ..... G08G 1/096725
2019/0049724 A1* 2/2019 Kimura ..... G02B 27/01
2019/0122546 A1* 4/2019 Lu ..... G08G 1/056
2019/0156664 A1* 5/2019 Yamada ..... G08G 1/0145

FOREIGN PATENT DOCUMENTS

CN 105197014 A 12/2015
CN 105788256 A 7/2016
JP 2010-266396 A 11/2010
JP 2011-186872 A 9/2011
JP 2015-022741 A 2/2015
JP 2016-062391 A 4/2016
JP 2017-211957 A 11/2017

* cited by examiner

*Primary Examiner* — Nga X Nguyen
(74) *Attorney, Agent, or Firm* — Oliff PLC

(57) ABSTRACT

A server device includes an acquisition unit configured to acquire vehicle information including at least positional information of a vehicle and related time information from a plurality of vehicles; and a congestion identification unit configured to acquire a speed of the vehicle obtained from the vehicle information and information of a road of multiple lanes in one direction based on map information, and identify that there are a congested lane and a non-congested lane among the multiple lanes in one direction based on speeds of a plurality of vehicles traveling on the same road of the multiple lanes in one direction.

7 Claims, 4 Drawing Sheets

SERVER DEVICE AND CONGESTION IDENTIFICATION METHOD

INCORPORATION BY REFERENCE

The disclosure of Japanese Patent Application No. 2017-242125 filed on Dec. 18, 2017 including the specification, drawings and abstract is incorporated herein by reference in its entirety.

BACKGROUND

1. Field of the Disclosure

The present disclosure relates to a server device and a congestion identification method which identifies that a road is congested.

2. Description of Related Art

Japanese Unexamined Patent Application Publication No. 2010-266396 (JP 2010-266396 A) discloses a navigation device that acquires congestion information of each lane from a VICS (Vehicle Information and Communication System) (registered trademark) receiver, determines whether or not there is a congestion in a travel lane of a host vehicle, and proposes an avoidance route.

SUMMARY

It is desirable to easily acquire congestion information, in particular, congestion information indicating that there are a congested lane and a non-congested lane among multiple lanes in one direction.

The disclosure provides a server device and a congestion identification method which easily identifies that there are a congested lane and a non-congested lane among multiple lanes in one direction.

A first aspect of the disclosure relates to a server device. The server device includes an acquisition unit and a congestion identification unit. The acquisition unit is configured to acquire vehicle information including at least positional information of a vehicle and related time information from a plurality of vehicles. The congestion identification unit is configured to acquire a speed of the vehicle obtained from the vehicle information and information of a road of multiple lanes in one direction based on map information, and identify that there are a congested lane and a non-congested lane among the multiple lanes in one direction based on speeds of a plurality of vehicles traveling on the same road of the multiple lanes in one direction.

According to the first aspect of the disclosure, it is possible to easily identify that there are the congested lane and the non-congested lane among the multiple lanes in one direction by deriving the speed of the vehicle from the positional information of the vehicle and checking the speeds of the vehicles traveling on the same road of the multiple lanes in one direction.

In the server device according to the first aspect of the disclosure, the congestion identification unit may be configured to determine a vehicle traveling at a low speed which is traveling at a lower speed than a normal speed or a vehicle traveling at a normal speed which is traveling at a higher speed than the vehicle traveling at a low speed, based on the speed of the vehicle derived from the vehicle information, and identify that there are the congested lane and the non-congested lane among the multiple lanes in one direction in a case where the vehicle traveling at a low speed and the vehicle traveling at a normal speed are included in the vehicles traveling on the same road of the multiple lanes in one direction.

The server device according to the first aspect of the disclosure may further include a storage unit configured to store congested lane identification information identifying a lane where a congestion occurred previously on the road of the multiple lanes in one direction. The congestion identification unit may be configured to identify a currently congested lane based on the stored congested lane identification information in a case where the vehicle traveling at a low speed and the vehicle traveling at a normal speed are included in the vehicles traveling on the same road of the multiple lanes in one direction.

In the server device according to the first aspect of the disclosure, the congestion identification unit may be configured to identify the congested lane among the multiple lanes in one direction by tracking an advancing direction of the vehicle traveling at a low speed.

In the server device according to the first aspect of the disclosure, the congestion identification unit may be configured to identify the congested lane among the multiple lanes in one direction based on congestion information posted by using a social networking service.

A second aspect of the disclosure relates to a congestion identification method. The congestion identification method includes acquiring vehicle information including at least positional information of a vehicle and related time information from a plurality of vehicles, acquiring a speed of the vehicle obtained from the vehicle information, acquiring information of a road of multiple lanes in one direction based on map information, and identifying that there are a congested lane and a non-congested lane among the multiple lanes in one direction based on speeds of a plurality of vehicles traveling on the same road of the multiple lanes in one direction.

According to the second aspect of the disclosure, it is possible to easily identify that there are the congested lane and the non-congested lane among the multiple lanes in one direction by deriving the speed of the vehicle from the positional information of the vehicle and checking the speeds of the vehicles traveling on the same road of the multiple lanes in one direction.

According to the aspect of the disclosure, it is possible to provide the server device and the congestion identification method which can easily identify that there are the congested lane and the non-congested lane among the multiple lanes in one direction.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
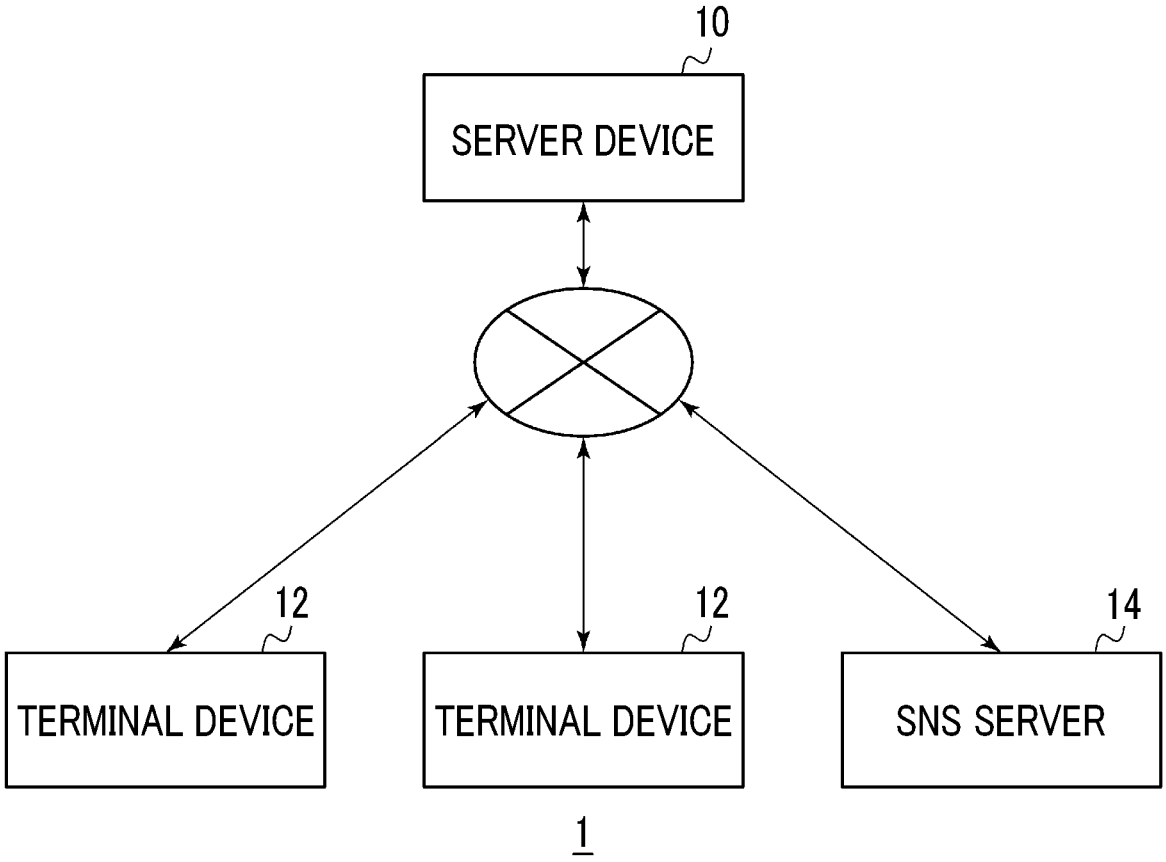
FIG. 1 is a schematic diagram showing a congestion identification system.

FIG. 1 is a schematic diagram showing a congestion identification system 1. The congestion identification system 1 is constituted by a server device 10, a terminal device 12, and an SNS server 14. The server device 10, the terminal device 12, and the SNS server 14 are connected via a network.

The terminal device 12 is provided in a vehicle, acquires positional information of the vehicle and related time information using a global positioning system (GPS), and periodically transmits the positional information of the vehicle and the related time information together with a vehicle ID to the server device 10. The terminal device 12 receives information on a congestion identified by the server device 10 and supports a driver's driving by using the information in a navigation device.

The server device 10 collects the acquired positional information of a plurality of vehicles from a plurality of terminal devices 12 and identifies a congested road based on the collected positional information of the vehicle, in particular, a road which has multiple lanes in one direction and is in a state of including a congested lane and a non-congested lane. The server device 10 uses information acquired from a social networking service server (hereinafter referred to as "SNS server 14") in order to identify the congested lane. The server device 10 transmits identified congested lane identification information to the terminal device 12 or the like.

The SNS server 14 receives a post of texts and images of a user and it is possible for other users to acquire the posted information. For example, a user driving on the congested road may post a captured image of the surroundings of the vehicle or information indicating a situation of the congestion to the SNS server 14 in order to utilize a free time. The server device 10 can acquire information from the user driving on the congested road from the SNS server 14.

Figure 2:
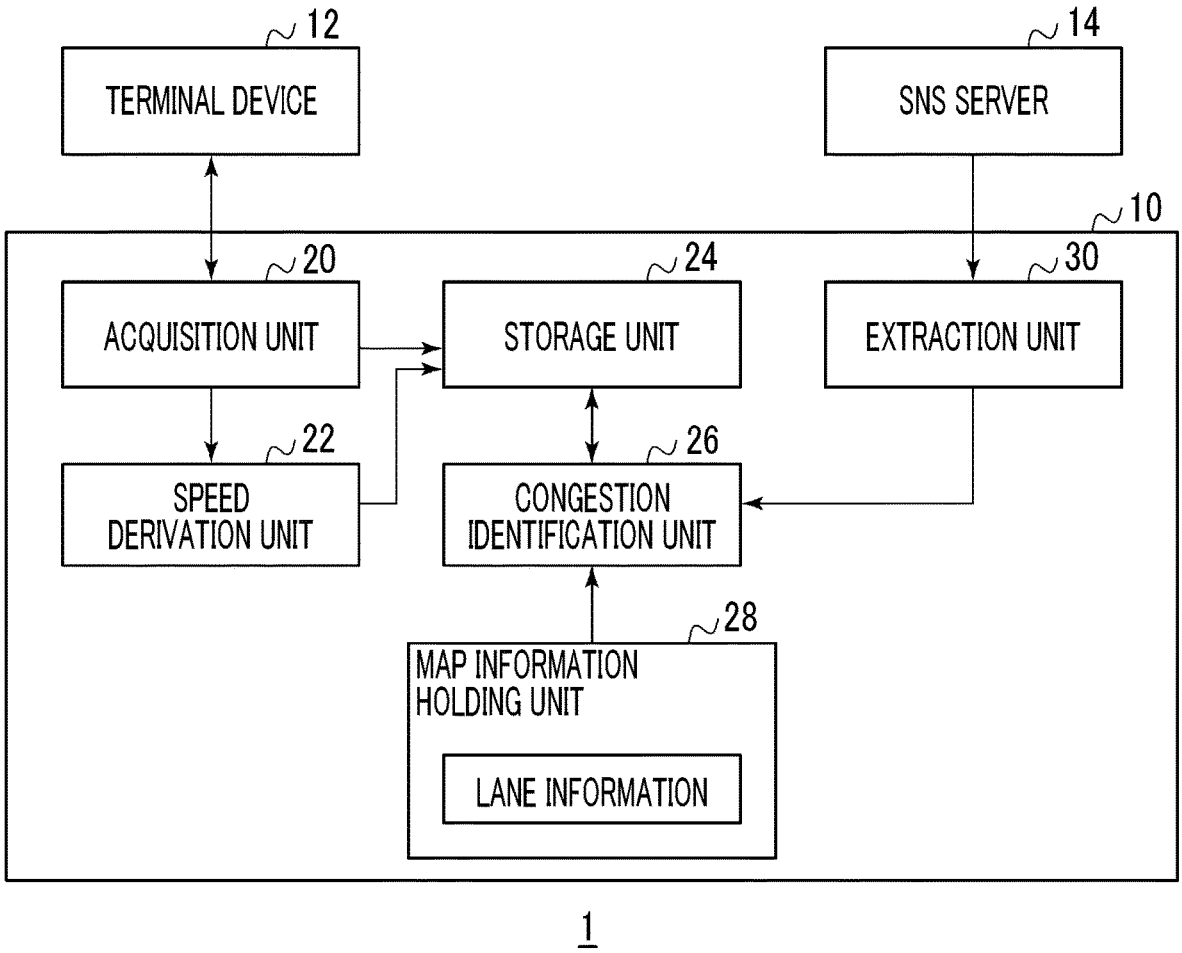
FIG. 2 is a diagram for describing a functional configuration of a server device.

FIG. 2 is a diagram for describing a functional configuration of the server device 10. In FIG. 2, each element described as a functional block performing various processing can be constituted by a circuit block, a memory, and another large scale integration (LSI) in terms of hardware and is realized by a program loaded on the memory in terms of software. Therefore, it is understood by those skilled in the art that the functional block can be realized in various forms by the hardware alone, the software alone, or a combination of the hardware and the software, and there is no limitation.

The server device 10 includes an acquisition unit 20, a speed derivation unit 22, a storage unit 24, a congestion identification unit 26, a map information holding unit 28, and an extraction unit 30. The acquisition unit 20 acquires vehicle information indicating the vehicle ID, the positional information of the vehicle, and the related time information from the terminal device 12 of the vehicles.

The map information holding unit 28 holds map information including lane information indicating the road of the multiple lanes in one direction. It is possible to extract the vehicle traveling on the road of the multiple lanes in one direction from the map information including the lane information.

The speed derivation unit 22 derives a speed of the vehicle in a predetermined section from the positional information of the vehicle and the related time information acquired by the acquisition unit 20. For example, the speed derivation unit 22 may derive the speed of the vehicle at intervals of 100 meters or may derive the speed of the vehicle in a preset section for each road. The section from which the speed derivation unit 22 derives the speed of the vehicle, for example, may be set to a section that is longer for a highway than for an ordinary road or may be set at intervals of 200 meters for the highway and 100 meters for the ordinary road. It is possible to determine whether or not the vehicle traveling on the preset section is traveling on the congested road by the speed of the vehicle derived by the speed derivation unit 22.

The storage unit 24 stores the positional information of the vehicle and the related time information, and the speed of the vehicle and a related section derived by the speed derivation unit 22 in association with the vehicle ID. The storage unit 24 stores the congested lane identification information in which the congested lane is identified by the congestion identification unit 26.

The congestion identification unit 26 acquires the lane information of the map information holding unit 28, extracts the vehicle traveling in the same road of the multiple lanes in one direction and identifies that the congested lane and the non-congested lane are included among the multiple lanes in one direction based on the speed derived by the speed derivation unit 22. The phenomenon that there are the congested lane and the non-congested lane among the multiple lanes of the same road in one direction is referred to as "lane-dependent congestion".

The congestion identification unit 26 determines a vehicle traveling at a low speed which is traveling at a lower speed than a normal speed (hereinafter referred to as "vehicle traveling at a low speed") or a vehicle traveling at a normal speed which is normally traveling at a higher speed than the vehicle traveling at a low speed. The congestion identification unit 26 determines that a vehicle traveling at a predetermined congestion vehicle speed or lower in the predetermined section, for example, traveling at a speed of 20 kilometers per hour or lower is the vehicle traveling at a low speed and determines that a vehicle traveling at a higher speed than the predetermined congestion vehicle speed in the predetermined section is the vehicle traveling at a normal speed. The predetermined congestion vehicle speed is a numerical value as a reference for extracting the vehicle traveling on the congested road, may be different depending on a type of the roads such as the ordinary road and the highway, and may be set, for example, to 40 kilometers per hour for the highway and may be set to 20 kilometers per hour for the ordinary road.

The congestion identification unit 26 identifies that there are the congested lane and the non-congested lane among the multiple lanes in one direction in a case where the vehicles traveling in the same orientation on the same road section of the multiple lanes in one direction include the vehicle traveling at a low speed and the vehicle traveling at a normal speed. As described above, it is possible to easily identify that the lane-dependent congestion occurs based on the speeds of the vehicles traveling on the same road.

The congestion identification unit 26 identifies that the lane-dependent congestion occurs when a rate of the vehicle traveling at a low speed included in the vehicles traveling on the same road section of the multiple lanes in one direction is calculated and the rate of the vehicle traveling at a low speed is in a predetermined range. For example, when the vehicles traveling at a low speed are included in the vehicles traveling on the same road section of the multiple lanes in one direction at a rate of 30% to 70%, the congestion identification unit 26 identifies that the lane-dependent congestion occurs in the section. Accordingly, the congestion identification unit 26 can detect a state in which a group of the vehicle traveling at a low speed and a group of the vehicle traveling at a normal speed are traveling together at a certain ratio on the same road of the multiple lanes in one direction and identify the road where the lane-dependent congestion occurs. Information of the road where the lane-dependent congestion occurs and is identified by the congestion identification unit 26 is stored in the storage unit 24.

The congestion identification unit 26 identifies the congested lane among the multiple lanes in one direction by tracking an advancing direction of the vehicle traveling at a low speed. The congestion identification unit 26 identifies that a left side lane is congested when a number of vehicles traveling at a low speed, that is, the predetermined number or more of the vehicles traveling at a low speed are turning left, and identifies that a right side lane is congested when a number of vehicles traveling at a low speed are turning right. The congestion identification unit 26 identifies that a through lane is congested when the vehicles traveling at a low speed are going straight ahead and a number of vehicles traveling at a normal speed are turning right or turning left. As described above, it is possible to identify the congested lane by tracking the advancing direction of the vehicle traveling at a low speed. The congestion identification unit 26 stores the identified congested lane identification information in the storage unit 24.

The congestion identification unit 26 identifies the congested lane among the multiple lanes in one direction based on the posted congestion information by using the SNS. The extraction unit 30 extracts the information on the road from the SNS server 14. The extraction unit 30 acquires a post including words in relation to the congestion, for example, "congestion", "crowded" and having information indicating a location in relation to the congestion from the SNS server 14. The congestion identification unit 26 identifies the congested lane by using the post.

Figure 3:
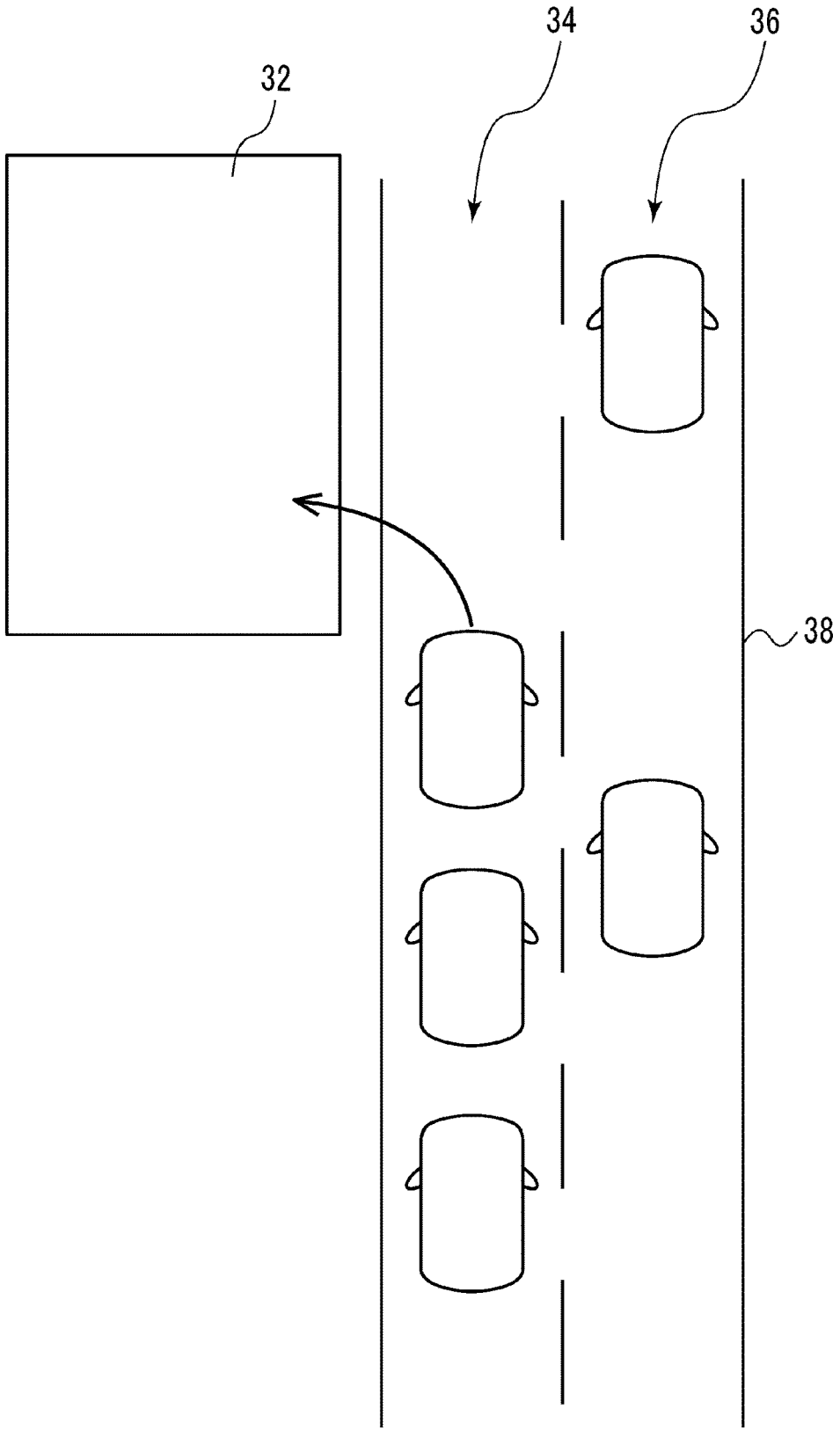
FIG. 3 is a diagram for describing a method of identifying a congested lane.

In FIG. 3 is a diagram for describing a method of identifying the congested lane. A left lane 34 of a road 38 is congested for the vehicle entering a certain facility 32 as shown in FIG. 3. The facility 32, for example, is a shopping mall or an event venue. While the left lane 34 is congested, the vehicle is traveling at the normal speed in a right lane 36. In this case, an occupant of the vehicle traveling in the left lane 34 provides a post that the facility 32 is crowded to the SNS server 14.

The extraction unit 30 extracts the post of "the facility 32 is crowded" from the SNS server 14. The congestion identification unit 26 identifies that the lane-dependent congestion occurs on the road 38 since the vehicle traveling at a low speed and the vehicle traveling at a normal speed are included in the vehicles traveling on the road 38. The congestion identification unit 26 identifies that the congested lane is the left lane 34 by using the posted information to the effect that the facility 32 is crowded, and the information that the lane-dependent congestion occurs on the road 38. The storage unit 24 holds data of the facility 32 in association with the congested lane due to the facility 32 or data of the positional information of the vehicle in association with the congested lane, as data for identifying the congested lane. As described above, the congestion identification unit 26 can identify the congested lane.

In a case where the road where the lane-dependent congestion occurs is identified, the congestion identification unit 26 may acquire an image of a front of the vehicle captured by an on-vehicle camera from the terminal device 12 of the vehicle traveling on the road where the lane-dependent congestion occurs, may analyze the captured image, and may identify the congested lane. As described above, the congestion identification unit 26 stores the information identifying the congested lane among the multiple lanes in one direction in the storage unit 24.

The congestion identification unit 26 identifies a currently congested lane based on the stored congested lane identification information in the past in a case where the vehicle traveling at a low speed and the vehicle traveling at a normal speed are included in the vehicles traveling on the same road section of the multiple lanes in one direction. That is, the congestion identification unit 26 identifies that the lane having a statistically high frequency of the congestion is the congested lane based on the congested lane identification information in the past stored in the storage unit 24 when the congestion identification unit 26 identifies the road where the lane-dependent congestion occurs and identifies the congested lane. The congestion identification unit 26 statistically calculates a congestion occurrence pattern identifying a road section, a lane, and a date and time such as a lane highly likely to be congested on weekday morning, a lane highly frequently congested on weekday evening, and a lane highly frequently congested on weekend daytime, from the congested lane identification information on the same road of multiple lanes in one direction. The congestion identification unit 26 identifies the congested lane of the road where the lane-dependent congestion occurs based on the congestion occurrence pattern in a case where the lane-dependent congestion occurs in the road section and the date and time conforming to the congestion occurrence pattern.

Figure 4:
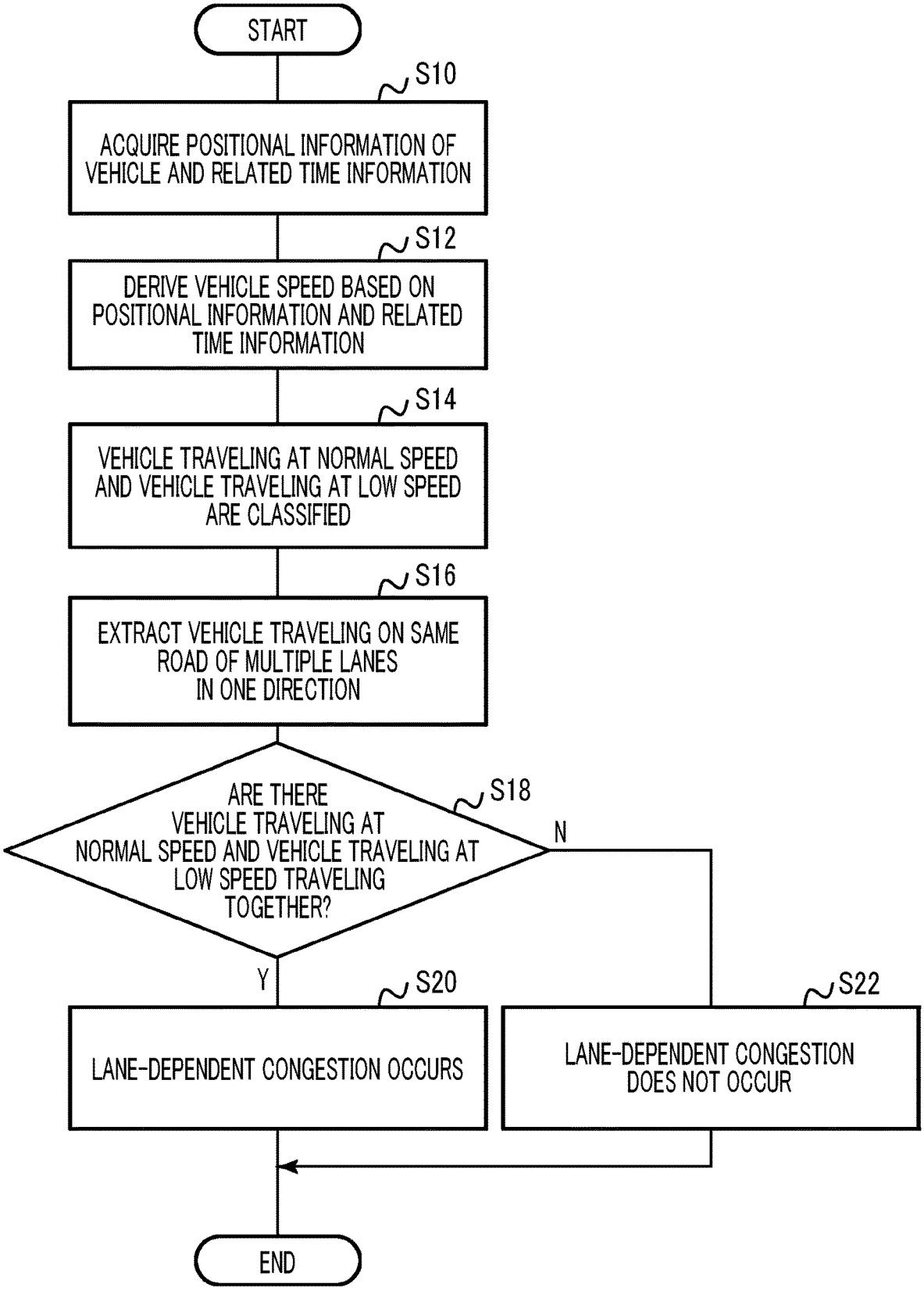
FIG. 4 is a flowchart for describing identification processing of a lane-dependent congestion.

FIG. 4 is a flowchart for describing identification processing of the lane-dependent congestion. The acquisition unit 20 of the server device 10 acquires the positional information of the vehicle and the related time information from the terminal device 12 of the vehicles (S10).

The speed derivation unit 22 derives the vehicle speed of the predetermined section based on the positional information of the vehicle and the related time information (S12). By the congestion identification unit 26, the vehicle traveling at a normal speed and the vehicle traveling at a low speed are classified based on the derived vehicle speed (S14).

The congestion identification unit 26 extracts the vehicle traveling in the same orientation on the same road of the multiple lanes in one direction (S16) and determines whether there are the vehicle traveling at a normal speed and the vehicle traveling at a low speed in the vehicles traveling together in the same orientation on the same road of the multiple lanes in one direction (S18).

The congestion identification unit 26 identifies that the lane-dependent congestion occurs on the road section (S20) in the case where the vehicle traveling at a normal speed and the vehicle traveling at a low speed are traveling together on the same road of the multiple lanes in one direction (Y of S18). The congestion identification unit 26 identifies that the lane-dependent congestion does not occur on the road section (S22) in a case where the vehicle traveling at a normal speed and the vehicle traveling at a low speed are not traveling together on the same road of the multiple lanes in one direction (N of S18). As described above, it is possible to identify the congested lane among the multiple lanes in one direction by deriving the speed of the vehicle from the positional information of the vehicle and checking the speeds of the vehicles traveling on the same road of the multiple lanes in one direction.

It is to be understood by those skilled in the art that the embodiment is merely an example, that various modifications by combinations of each component are possible, and that such modifications are also within the scope of the disclosure.

The embodiment shows the aspect that the server device 10 derives the speed of the vehicle based on the positional information of the terminal device 12; however, the embodiment is not limited thereto. For example, the terminal devices 12 of the vehicles may transmit vehicle speed information of host vehicles in a state of being included in the vehicle information to the server device 10, and the congestion identification unit 26 of the server device 10 may determine the vehicles traveling at a low speed from the vehicle speed information acquired from the terminal devices 12. The congestion identification unit 26 identifies the congested section of the multiple lanes in one direction where there are the vehicles traveling at a low speed, and identifies the road where the lane-dependent congestion occurs when there are vehicles traveling at a normal speed in the identified congested section, that is, when there are the vehicles traveling at a normal speed at a predetermined rate or higher in the congested section where there are a number of vehicles traveling at a low speed.

What is claimed is:

1. A server device comprising a processor programmed to:

acquire vehicle information including at least positional information of a vehicle and corresponding time information from a plurality of vehicles, including the vehicle, traveling on a same road;

determine a speed of each of the plurality of vehicles traveling on the road based on the acquired vehicle information and information of the road, which includes multiple lanes in one direction based on map information;

determine, from among the plurality of vehicles, one or more slow vehicles each having the speed of the respective vehicle determined to be at or lower than a predetermined congestion speed;

calculate a ratio of the one or more slow vehicles to the plurality of vehicles;

determine that the multiple lanes in the one direction include a congested lane and a non-congested lane when the calculated ratio of the one or more slow vehicles to the plurality of vehicles is within a predetermined range; and identify the congested lane and the non-congested lane among the multiple lanes in the one direction based on the determined respective speeds of the plurality of vehicles and the determined one or more slow vehicles, the identified congested lane including the determined one or more slow vehicles.

2. The server device according to claim 1, wherein the processor is programmed to:

determine the one or more slow vehicles traveling at a low speed, each of which is traveling at a lower speed than a normal speed, and a vehicle of the plurality of vehicles traveling at a normal speed, which is traveling at a higher speed than the one or more slow vehicles traveling at the low speed, based on the speed of each of the plurality of vehicles; and identify the congested lane and the non-congested lane among the multiple lanes in the one direction when the one or more slow vehicles traveling at the low speed and the vehicle traveling at the normal speed are traveling on the same road of the multiple lanes in the one direction.

3. The server device according to claim 2, further comprising a memory configured to store congested lane identification information identifying a lane where a congestion occurred previously on the road of the multiple lanes in the one direction, wherein the processor is programmed to identify a currently congested lane based on the stored congested lane identification information when the one or more slow vehicles traveling at the low speed and the vehicle traveling at the normal speed are traveling on the same road of the multiple lanes in the one direction.

4. The server device according to claim 2, wherein the processor is programmed to identify the congested lane among the multiple lanes in the one direction by tracking an advancing direction of each of the one or more slow vehicles traveling at the low speed.

5. The server device according to claim 2, wherein the processor is programmed to identify the congested lane among the multiple lanes in the one direction based on congestion information posted by using a social networking service.

6. The server device according to claim 1, further comprising a memory configured to store congested lane identification information indicating the congested lane and the non-congested lane among the multiple lanes in the one direction.

7. A congestion identification method comprising:

acquiring vehicle information including at least positional information of a vehicle and corresponding time information from a plurality of vehicles, including the vehicle, traveling on a same road;

determining a speed of each of the plurality of vehicles traveling on the road based on the acquired vehicle information and information of the road, which includes multiple lanes in one direction based on map information;

determining, from among the plurality of vehicles, one or more slow vehicles each having the speed of the respective vehicle determined to be at or lower than a predetermined congestion speed;

calculating a ratio of the one or more slow vehicles to the plurality of vehicles;

determining that the multiple lanes in the one direction include a congested lane and a non-congested lane when the calculated ratio of the one or more slow vehicles to the plurality of vehicles is within a predetermined range; and identifying the congested lane and the non-congested lane among the multiple lanes in the one direction based on the determined respective speeds of the plurality of vehicles and the determined one or more slow vehicles, the identified congested lane including the determined one or more slow vehicles.

* * * * *